US010208501B2

(12) United States Patent
Jin

(10) Patent No.: US 10,208,501 B2
(45) Date of Patent: Feb. 19, 2019

(54) LAMP-EQUIPPED TENT SHELF

(71) Applicant: Xiamen Innovation Metal Products Co., Ltd., Xiamen (CN)

(72) Inventor: Juyoung Jin, Xiamen (CN)

(73) Assignee: Xiamen Innovation Metal Products Co., LTD., Xiamen (CN)

( * ) Notice: Subject to any disclaimer, the term of this patent is extended or adjusted under 35 U.S.C. 154(b) by 0 days.

(21) Appl. No.: 15/640,346

(22) Filed: Jun. 30, 2017

(65) Prior Publication Data

US 2018/0002945 A1 Jan. 4, 2018

(30) Foreign Application Priority Data

Jul. 4, 2016 (CN) ..... 2016 2 0691069 U

(51) Int. Cl.

| | |
|---|---|
| ***E04H 15/10*** | (2006.01) |
| ***F21S 4/20*** | (2016.01) |
| ***E04H 15/32*** | (2006.01) |
| ***F21S 9/00*** | (2006.01) |
| ***F21V 19/00*** | (2006.01) |
| ***F21V 23/02*** | (2006.01) |
| ***F21V 23/04*** | (2006.01) |
| ***F21V 23/06*** | (2006.01) |
| ***F21V 33/00*** | (2006.01) |
| *F21Y 115/10* | (2016.01) |

(52) U.S. Cl.

CPC ..... *E04H 15/10* (2013.01); *E04H 15/32* (2013.01); *F21S 4/20* (2016.01); *F21S 9/00* (2013.01); *F21V 19/003* (2013.01); *F21V 23/023* (2013.01); *F21V 23/04* (2013.01); *F21V 23/06* (2013.01); *F21V 33/008* (2013.01); *F21Y 2115/10* (2016.08)

(58) Field of Classification Search

CPC .. E04H 15/10; E04H 15/32; F21S 4/20; F21S 9/00; F21V 19/003; F21V 23/023; F21V 23/04; F21V 23/06; F21V 33/008; F21Y 2115/10

USPC ..... 362/145

See application file for complete search history.

(56) References Cited

U.S. PATENT DOCUMENTS

| | | | | |
|---|---|---|---|---|
| 5,681,106 | A * | 10/1997 | Coultas | F21L 15/02 362/190 |
| 7,191,788 | B2 * | 3/2007 | Holub | E04H 15/14 135/115 |
| 7,980,401 | B1 * | 7/2011 | Staraitis | A47B 43/006 211/113 |
| 8,656,842 | B1 * | 2/2014 | McDonley | A47B 43/006 108/149 |
| 2002/0104841 | A1 * | 8/2002 | Choi | E04H 15/32 220/62 |
| 2009/0103314 | A1 * | 4/2009 | Hammer | E04B 9/303 362/351 |

* cited by examiner

*Primary Examiner* — Laura Tso
(74) *Attorney, Agent, or Firm* — Morgan, Lewis & Bockius LLP

(57) ABSTRACT

A lamp-equipped tent shelf, comprising a shelf, an LED lighting assembly, and a plurality of hooks is provided. The hooks are connected to the shelf. The LED lighting assembly is disposed on the shelf. The LED assembly comprises a power source, an LED light source and a switch. The LED light source is connected to the power source and the switch control the LED light source to turn on and off. The tent shelf can be hung directly to the tent frame and serves as an illumination source.

18 Claims, 5 Drawing Sheets

LAMP-EQUIPPED TENT SHELF

CROSS-REFERENCE TO RELATED APPLICATION

The present application claims priority to Chinese Application No. 201620691069.8, filed Jul. 4, 2016, the entire contents of which are incorporated herein for all purposes by this reference.

TECHNICAL FIELD

The present invention relates to a shelf, and specifically relates to a lamp-equipped tent shelf.

BACKGROUND

Along with the fast development of the society and economy, people become increasingly fond of outdoor recreation activities. Tents are popular, because they are convenient to carry and can provide a temporary outdoor venue for people to rest during outdoor activities. To be conveniently carried around, a tent typically has a small interior space. Other articles can only be placed outside the tent or on the ground inside the tent. Some articles, such as food, may attract ants or other insects, thereby making these articles dirty and leading to waste. In addition, additional lamps are further needed to provide illumination for instance at night, which increases purchase cost and make tents difficult to carry.

The information disclosed in this background section is only for enhancement of understanding of the general background of the invention and should not be taken as an acknowledgement or any form of suggestion that this information forms the prior art already known to a person skilled in the art.

SUMMARY

To solve the above technical problem, the object of the present disclosure is to provide a lamp-equipped tent shelf which can be hung directly to the tent frame and provide illumination when desired.

One aspect of the present disclosure provides a lamp-equipped tent shelf, comprising a shelf, an LED lighting assembly and a plurality of hooks. The plurality of hooks is connected to the shelf. The LED lighting assembly is disposed on the shelf. The LED lighting assembly comprises a power source, an LED light source and a switch. The LED light source is connected to the power source, and the switch controls the LED light source to turn on and off.

In some embodiments, the shelf comprises a frame and a bottom plate. The bottom plate is disposed at the bottom of the frame and is connected to the frame. In some embodiments, the bottom plate is made of mesh and/or cloth.

In some embodiments, the LED light source is disposed on the inner side of the frame, and the light emitted by the LED light source can pass through the base plate. In some such embodiments, the frame has a rectangular shape, the frame is internally provided with a partition, and the power source is placed in a space enclosed by the partition and the frame. In some embodiments, the LED light source is disposed at the four corners of the inner side of the frame. In some embodiments, the LED light source is disposed linearly inside the frame.

In some embodiments, the switch is disposed on the outer surface of the frame.

In some embodiments, a hook in the plurality of hooks is further provided with an elastic band. A first end of the elastic band is connected to the hook and a second end of the elastic band is connected to the shelf.

Figure 1:
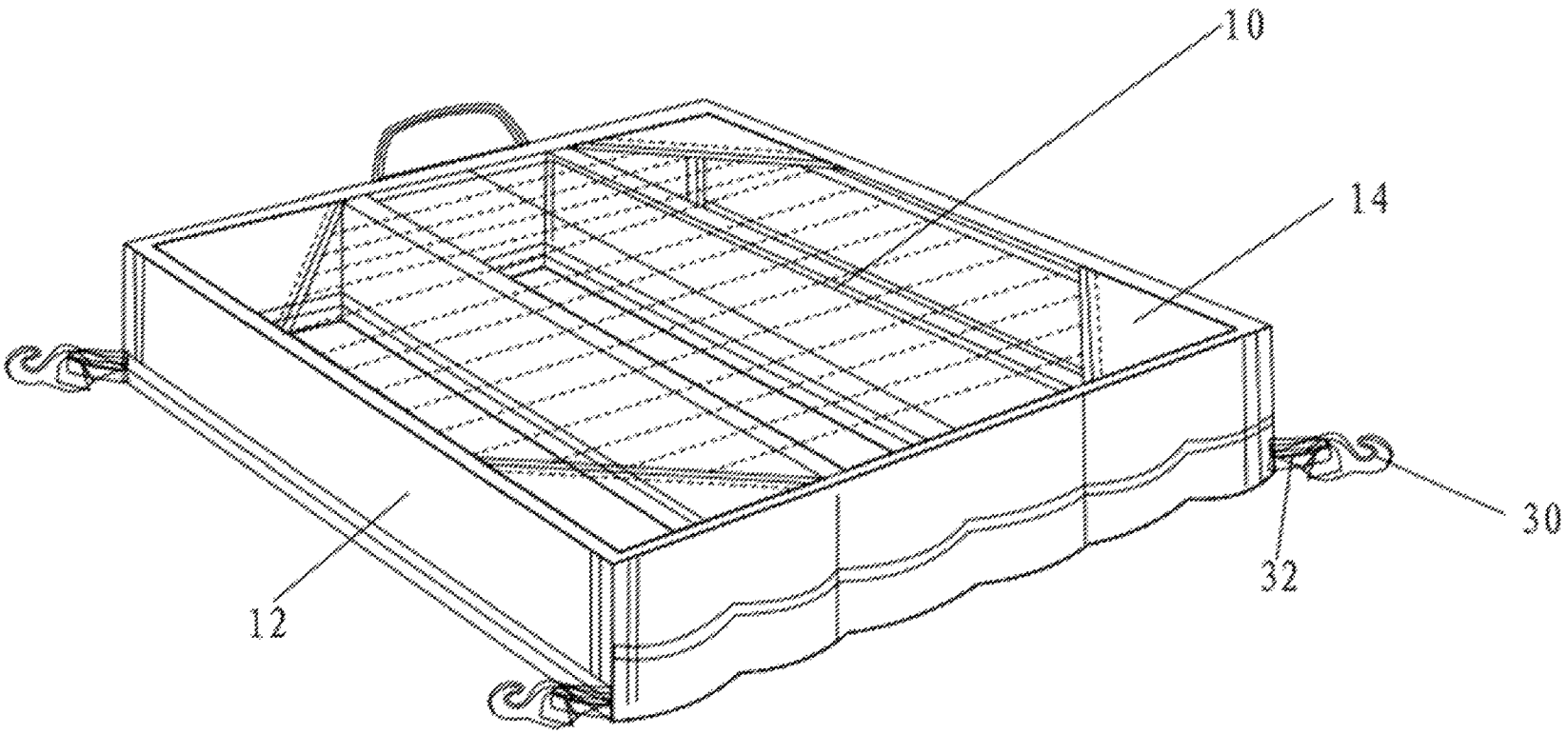
FIG. 1 is a bottom perspective view of a lamp-equipped tent shelf according to an exemplary embodiment of the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawing and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the present invention as defined by the appended claims.

It will also be understood that, although the terms first, second, etc. may be used herein to describe various elements, these elements should not be limited by these terms. These terms are only used to distinguish one element from another. For example, a first subject could be termed a second subject, and, similarly, a second subject could be termed a first subject, without departing from the scope of the present disclosure. The first subject and the second subject are both subjects, but they are not the same subject. Furthermore, the terms "subject" and "user" are used interchangeably herein.

The terminology used in the present disclosure is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or"

as used herein refers to and encompasses any and all possible combinations of one or more of the associated listed items. It will be further understood that the terms "comprises" and or "comprising," when used in this specification, specify the presence of stated features, integers, steps, operations, elements, and or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

In the description of details below, part legends will be marked in the accompanying drawings and become a part thereof, and moreover, they will be presented through a description of a specific example capable of implementing said embodiment. These types of embodiments will provide sufficient details such that those skilled in the art will be able to implement the same. Readers must understand that other embodiments may also be used in the present utility model, or structural, logical and electrical changes may be made without departing from the embodiments. Therefore, the detailed description below may not be construed as a limitation. On the contrary, the embodiments comprised therein shall be defined by the claims.

Figure 2:
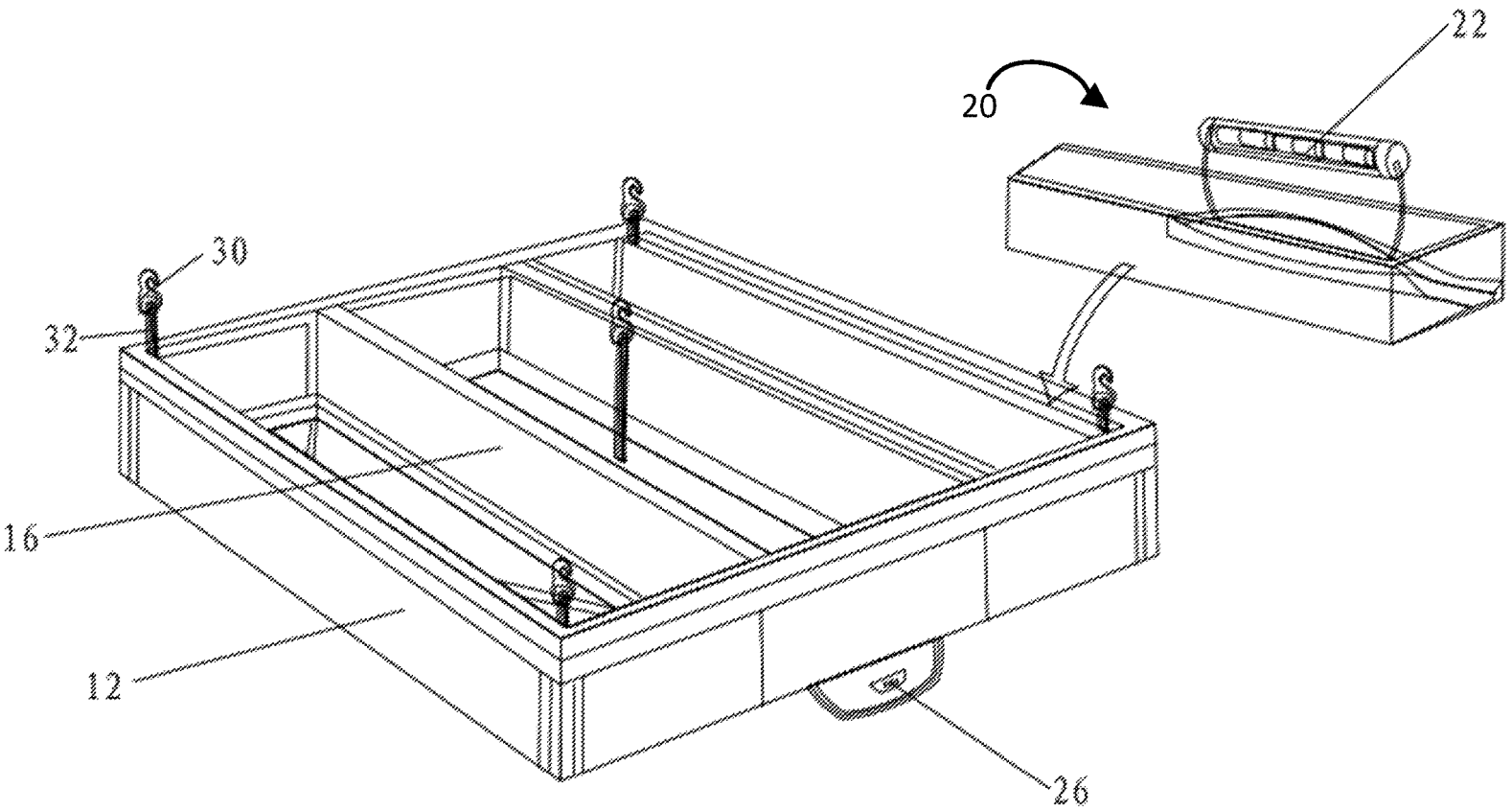
FIG. 2 is a top perspective and partially exploded view of a lamp-equipped tent shelf according to an exemplary embodiment of the present disclosure.
Figure 3:
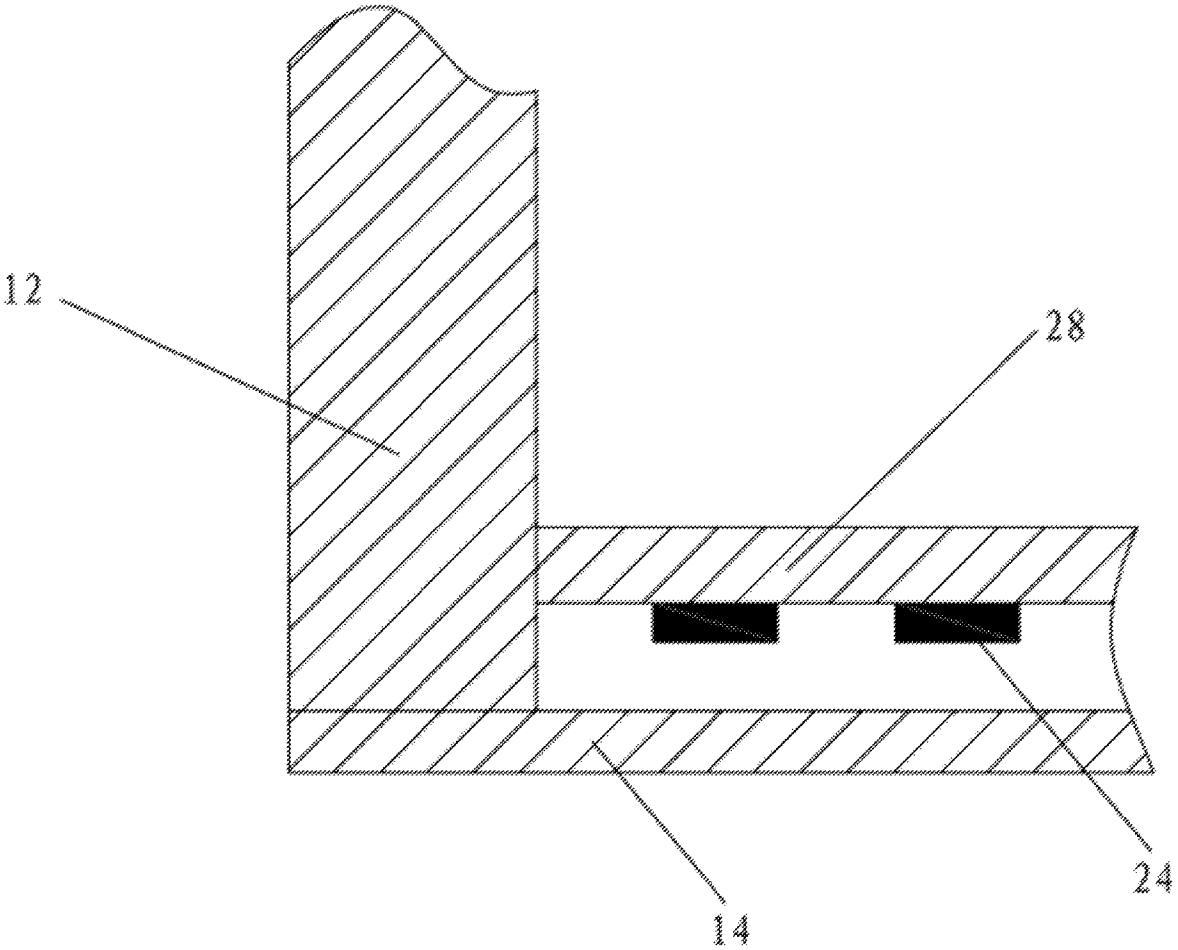
FIG. 3 is a partial cross-sectional view of a lamp-equipped tent shelf according to an exemplary embodiment of the present disclosure.

As shown in FIG. 1 to FIG. 3, a lamp-equipped tent shelf comprises a shelf 10, an LED lighting assembly 20, and a plurality of hooks 30. The hooks 30 are connected to the shelf 10. The LED lighting assembly 20 is disposed on the shelf 10.

Figure 5:
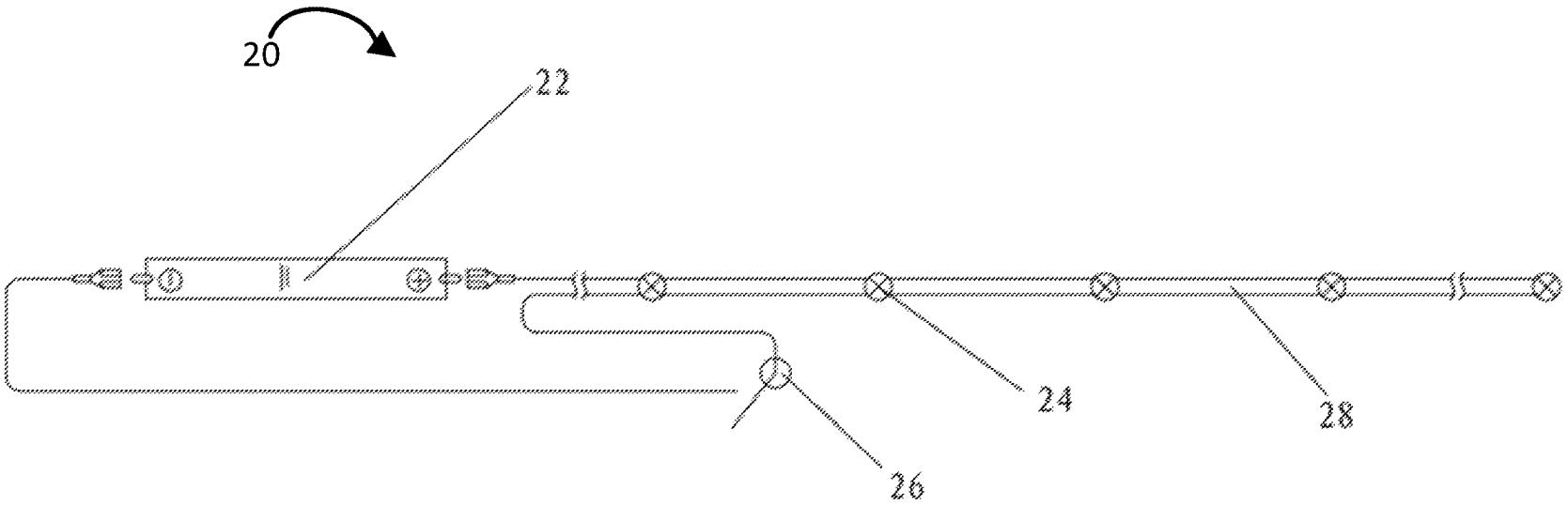
FIG. 5 is a schematic diagram illustrating linear connection of lighting assemblies according to an exemplary embodiment of the present disclosure.

As illustrated in FIG. 5, the lighting assembly 20 comprises a power source 22, an LED light source 24 and a switch 26. The LED light source 24 is connected to the power source 22. The switch 26 can control the LED light source 24 to turn it on and off.

Referring to FIG. 1 and FIG. 2, the hook 30 is further provided with an elastic band 32. One end of the elastic band 32 is connected to the hook 30, and the other end is connected to the shelf 10. With the elastic band 32, the hook 30 can be conveniently hung to the tent frame, such that the entire shelf is suspended to the top of the tent.

Referring to FIG. 1 to FIG. 3, the shelf 10 comprises a frame 12 and a base plate 14. The base plate 14 is disposed at the bottom of the frame 12 and is connected to the frame 12. In some embodiments, the base plate is made of mesh and/or cloth. Preferably, the LED light source 24 is disposed on the inner side of the frame 12.

Referring to FIG. 3, the LED light source 24 is attached to a PCB board 28, and the PCB board 28 is secured to the frame 12. The light emitted by the LED light source passes through the base plate and is emitted. The light emitted by the LED light source can pass through the base plate 14, thereby scattering the light, such that the illumination area is bigger, and the light is more soft and does not cause glare.

Referring to FIG. 1 and FIG. 2, the frame 12 has a rectangular shape. The frame is also internally provided with a partition 16. The power source 22 is placed in the space enclosed by the partition 16 and the frame 12.

Figure 4:
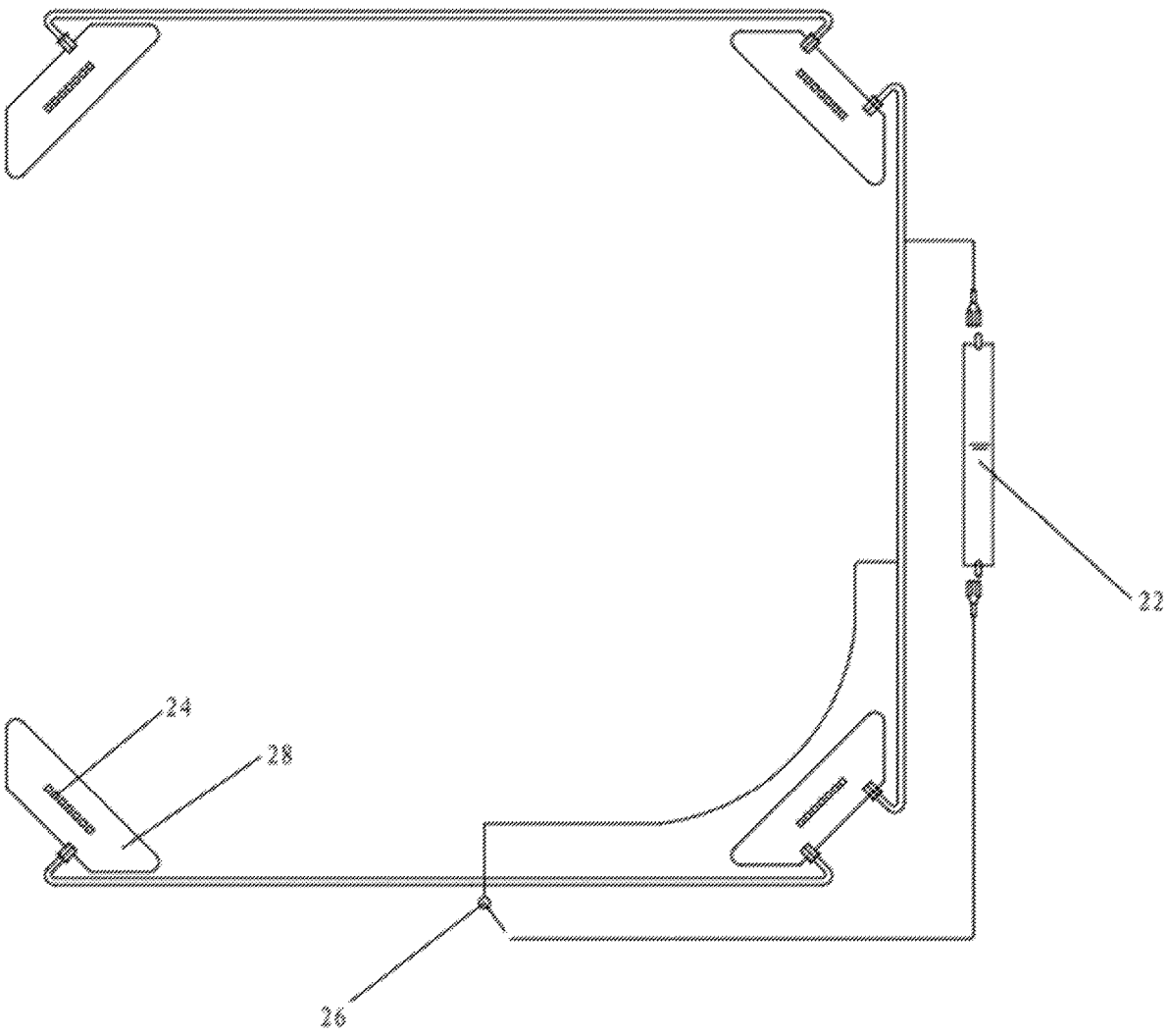
FIG. 4 is a schematic diagram illustrating connection of lighting assemblies placed at 4 corners of the frame according to an exemplary embodiment of the present disclosure.

Referring to FIG. 4, preferably, the LED light source 24 is disposed at the four corners of the inner side of the frame 12.

Referring to FIG. 5, similarly, the LED light source 24 may also be disposed linearly inside the frame. Referring to FIG. 4 and FIG. 5, to facilitate electrical connection between each PCB board and the power source, the PCB board may be provided with a female connector, and the power source, the switch and the LED light source are connected with each other via cords having male connectors.

Referring to FIG. 1 to FIG. 2, to facilitate the lighting assemblies to turn on and off, the switch 26 is disposed on the outer surface of the frame.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various alternatives and modifications thereof. It is intended that the scope of the invention be defined by the Claims appended hereto and their equivalents.

What is claimed is:

1. A lamp-equipped tent shelf, comprising:

a shelf comprising a frame and a bottom plate, wherein the bottom plate is disposed at a bottom of the frame and coupled with the frame;

an LED lighting assembly; and a plurality of hooks, wherein the plurality of hooks is connected to the shelf, the LED lighting assembly is disposed on the shelf, the LED lighting assembly comprises a power source, an LED light source and a switch, the LED light source is connected to the power source, and the switch controls the LED light source to turn on and off, the LED light source is coupled with the frame above the bottom plate, and the bottom plate is configured to scatter the light emitted from the LED light source, thereby providing soft illumination to an area below the bottom plate.

2. A lamp-equipped tent shelf, comprising:

a shelf;

an LED lighting assembly; and a plurality of hooks, wherein the plurality of hooks is connected to the shelf, the LED lighting assembly is disposed on the shelf, the LED lighting assembly comprises a power source, an LED light source and a switch, and the LED light source is connected to the power source, and the switch controls the LED light source to turn on and off, wherein the shelf comprises a frame and a bottom plate, the bottom plate is disposed at the bottom of the frame and is connected to the frame, and the bottom plate is made of mesh, or made of cloth, or made of a combination of mesh and cloth.

3. The lamp-equipped tent shelf according to claim 2, wherein the LED light source is disposed on the inner side of the frame, and the light emitted by the LED light source can pass through the base plate and be emitted.

4. The lamp-equipped tent shelf according to claim 2, wherein the frame has a rectangular shape, the frame is internally provided with a partition, and the power source is placed in a space enclosed by the partition and the frame.

5. The lamp-equipped tent shelf according to claim 4, wherein the LED light source is disposed at the four corners of the inner side of the frame.

6. The lamp-equipped tent shelf according to claim 2, wherein the LED light source is disposed linearly inside the frame.

7. The lamp-equipped tent shelf according to claim 2, wherein the switch is disposed on the outer surface of the frame.

8. The lamp-equipped tent shelf according to claim 6, wherein the switch is disposed on the outer surface of the frame.

9. The lamp-equipped tent shelf according to claim 2, wherein a hook in the plurality of hooks is further provided with an elastic band, wherein a first end of the elastic band is connected to the hook and a second end of the elastic band is connected to the shelf.

10. The lamp-equipped tent shelf according to claim 3, wherein a hook in the plurality of hooks is further provided with an elastic band, wherein a first end of the elastic band is connected to the hook and a second end of the elastic band is connected to the shelf.

11. The lamp-equipped tent shelf according to claim 4, wherein a hook in the plurality of hooks is further provided with an elastic band, wherein a first end of the elastic band is connected to the hook and a second end of the elastic band is connected to the shelf.

12. The lamp-equipped tent shelf according to claim 5, wherein a hook in the plurality of hooks is further provided with an elastic band, wherein a first end of the elastic band is connected to the hook and a second end of the elastic band is connected to the shelf.

13. The lamp-equipped tent shelf according to claim 6, wherein a hook in the plurality of hooks is further provided with an elastic band, wherein a first end of the elastic band is connected to the hook and a second end of the elastic band is connected to the shelf.

14. The lamp-equipped tent shelf according to claim 7, wherein a hook in the plurality of hooks is further provided with an elastic band, wherein a first end of the elastic band is connected to the hook and a second end of the elastic band is connected to the shelf.

15. The lamp-equipped tent shelf according to claim 8, wherein a hook in the plurality of hooks is further provided with an elastic band, wherein a first end of the elastic band is connected to the hook and a second end of the elastic band is connected to the shelf.

16. The lamp-equipped tent shelf according to claim 2, wherein the frame has a rectangular shape.

17. The lamp-equipped tent shelf according to claim 2, wherein the frame is internally provided with one or more partitions.

18. The lamp-equipped tent shelf according to claim 17, wherein the power source is placed in a space enclosed by the frame and a partition in the one or more partitions.

* * * * *